US006537129B1

(12) United States Patent
Kane

(10) Patent No.: US 6,537,129 B1
(45) Date of Patent: Mar. 25, 2003

(54) TOY DOLL BED HAVING JUMPING DOLL

(75) Inventor: Erika Kane, San Pedro, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/159,667

(22) Filed: May 31, 2002

(51) Int. Cl.[7] ..... A63H 3/18
(52) U.S. Cl. ..... 446/323; 446/479; 446/482
(58) Field of Search ..... 446/268, 308, 446/309, 323, 334, 335, 336, 479, 486, 330, 482

(56) References Cited

U.S. PATENT DOCUMENTS

| | | | | |
|---|---|---|---|---|
| 1,736,163 A | * | 11/1929 | McGee | 446/334 |
| 2,445,387 A | * | 7/1948 | Davis | 446/322 |
| 2,531,260 A | * | 11/1950 | Davenport | 446/335 |
| 2,760,306 A | * | 8/1956 | Pelletier | 446/334 |
| 2,969,124 A | | 1/1961 | Nissen | |
| 3,528,385 A | | 9/1970 | Kohner et al. | |
| 3,634,966 A | | 1/1972 | Ostrander | |
| 3,669,451 A | | 6/1972 | Welbourn | |
| 3,744,182 A | | 7/1973 | Terzian et al. | |
| 3,839,820 A | | 10/1974 | Serman, Jr. | |
| 3,977,122 A | | 8/1976 | Meyer et al. | |
| 4,120,117 A | | 10/1978 | Terzian et al. | |
| 4,804,323 A | | 2/1989 | Kim | |
| 5,344,156 A | | 9/1994 | Levin | |
| 5,370,571 A | | 12/1994 | Bosch | |
| 5,435,570 A | | 7/1995 | Labrasseur | |
| 5,505,463 A | | 4/1996 | Hirose et al. | |
| 5,622,490 A | | 4/1997 | Cheng | |
| 5,813,946 A | | 9/1998 | Lin et al. | |
| 6,056,623 A | | 5/2000 | Arriola | |

* cited by examiner

*Primary Examiner*—Jacob K. Ackun
*Assistant Examiner*—Faye Francis
(74) *Attorney, Agent, or Firm*—Roy A. Ekstrand

(57) ABSTRACT

A generally square-shaped doll bed includes a square base supporting a quartet of vertical posts at its corners. The base defines a center recess within which a platform is supported by a pivoting arm. The pivoting arm is secured to a further pivoting arm which extends outward beyond the base and terminates in a depressible pad. A doll is supported above the platform by a pair of resilient bands secured to frame members coupled between the vertical posts. As the user depresses and releases the pad, the platform exerts upward forces against the doll causing it to move in a jumping action.

1 Claim, 2 Drawing Sheets

TOY DOLL BED HAVING JUMPING DOLL

FIELD OF THE INVENTION

This invention relates generally to dolls and doll accessories and particularly to those doll accessory which impart motion or activity to a cooperating doll.

BACKGROUND OF THE INVENTION

Dolls and doll accessories are well known in the art and have proven to be a popular and long lasting form of toys for young girls in particular. Not surprisingly, the popularity of dolls and doll accessories has prompted practitioners in the art to provide a virtually endless variety of dolls and doll accessories for use therewith.

One of the more pervasive types of doll accessories is found in doll sized furniture and accommodations for playsets having doll houses or other play environments. Such accessories have often included doll sized furniture items such as kitchen equipment, chairs, couches, tables and bedroom apparatus such as beds and night tables. A somewhat different type of doll accessory has also been provided in sport or game activity type accessories. Thus, accessories have been provided which, in part, jumping or other motions to dolls. In many of these doll apparatus, the doll itself is a simple molded plastic or similar doll fabrication completely lacking in any motion or movement capability.

Despite the continuing and virtually tireless effort of practitioners in the toy arts to provide new and more amusing doll accessories for use in play patterns with dolls, there remains a continuing need in the art for evermore improved, amusing and interesting doll accessories.

SUMMARY OF THE INVENTION

Accordingly, it is a general object of the present invention to provide an improved accessory for use in a doll play sets. It is a more particular object of the present invention to provide an improved accessory for use in a doll playset which imparts jumping motion to a cooperating doll.

In accordance with the present invention there is provided a toy doll bed comprising: a base having an upper surface and a recess; a fabric layer loosely spanning the recess; a platform and a pivot arm supporting the platform within the recess beneath the fabric layer; a depressible pad and arm coupled to the pivot arm; a pivot pivotally supporting the arm and the pivot arm; a doll; and means for resiliently supporting the doll upon the fabric and the platform.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
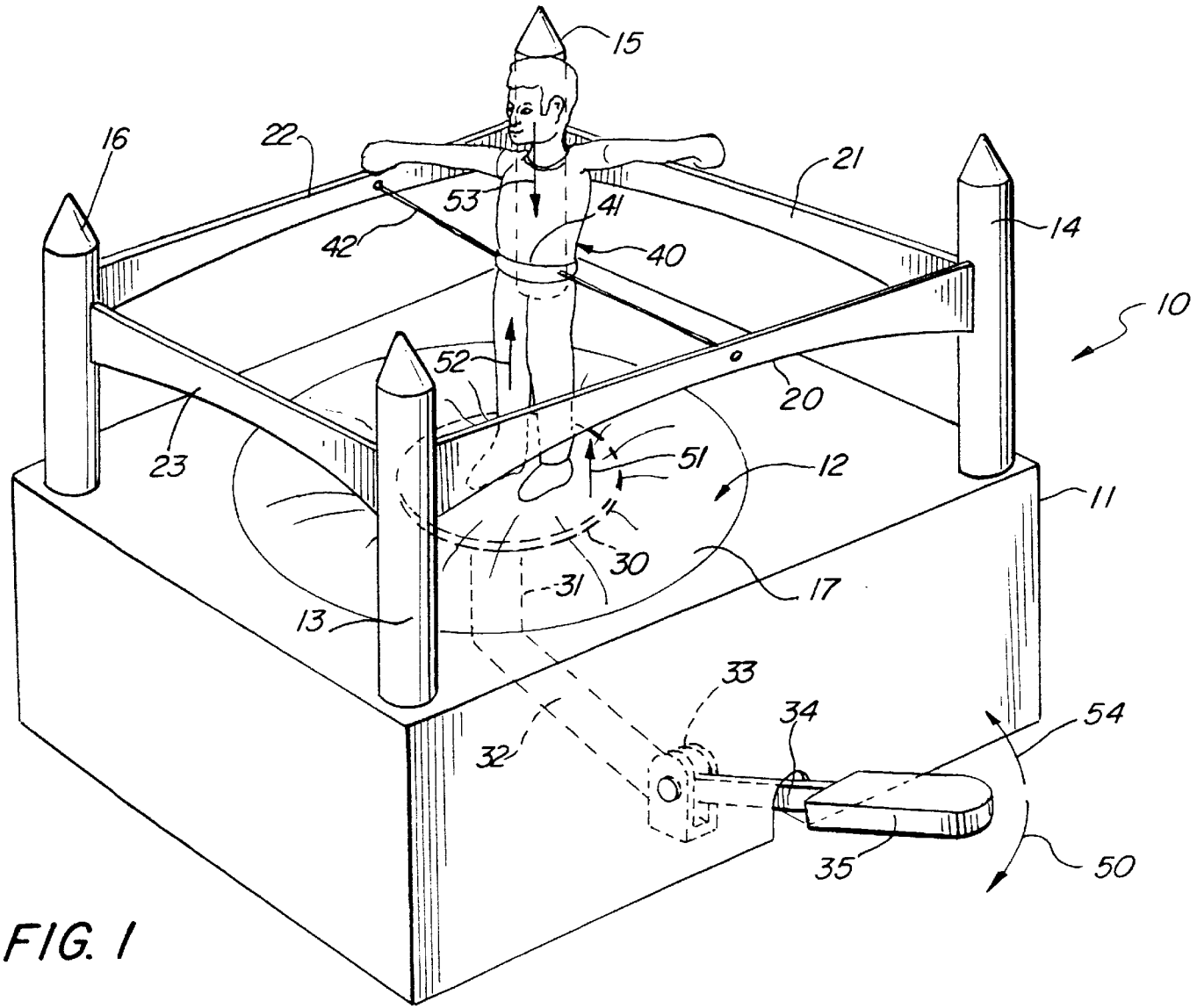
FIG. 1 sets forth a perspective view of a toy doll bed having a jumping doll constructed in accordance with the present invention.

FIG. 1 sets forth a perspective view of a toy doll bed having a jumping doll constructed in accordance with the present invention and generally referenced by numeral 10. Toy doll bed 10 includes a generally rectangular base 11 having a fabric cover 17 formed thereon. Base 11 further supports a plurality of vertical posts 13, 14, 15 and 16 positioned at the corners of base 11 and linked by a plurality of frame members 20, 21, 22 and 23. Base 11 further defines a recess 12 within which fabric cover 17 is loosely sagging.

In accordance with the present invention, a platform 30 is positioned beneath fabric cover 17 in recess 12 and is supported by a post 31 which in turn is supported by an arm 32. Arm 32 is pivotally secured to a pivot 33 and an arm 34. Arm 34 extends outwardly beyond base 11 and fabric cover 17 and is joined to a pad 35.

In accordance with the present invention, a doll 40 is supported above recess 12 by a waist band 41 and a pair of extending elastic bands 42 and 43. Bands 42 and 43 resilient secure doll 40 to frame members 20 and 22. Doll 10 is movable vertically as elastic bands 42 and 43 are stretched.

In operation, doll 40, due to its weight and balance generally rests upon the upper surface of fabric cover 17 above platform 30 as fabric cover 17 relaxes downwardly into recess 12. Play is initiated as the child user forces pad 35 downwardly in the direction indicated by arrow 50. This downward movement of pad 35 causes platform 30 to be moved vertically in the direction indicated by arrow 51 raising doll 40 against the resilient force of bands 42 and 43.

The user then releases pad 35 which, due to the offset positioning of pivot 33, causes pad 35 to rise in the direction indicated by arrow 54. The rise of pad 35 is accompanied by a corresponding drop of platform 30. As platform 30 drops, the support of doll 40 is removed and the elastic energy stored in bands 42 and 43 drives doll 40 downwardly in the direction indicated by arrow 53.

The user is able to depress and release pad 35 to provide successive jumping and falling of doll 40 as the dolls weight and the forces exerted by platform 30 interact with the resilient forces of elastic bands 42 and 43.

The result is a jumping action for doll 40 which, after the user masters the timing and skill of moving pad 35, can be caused to undergo various trick or stunt movements.

Figure 2:
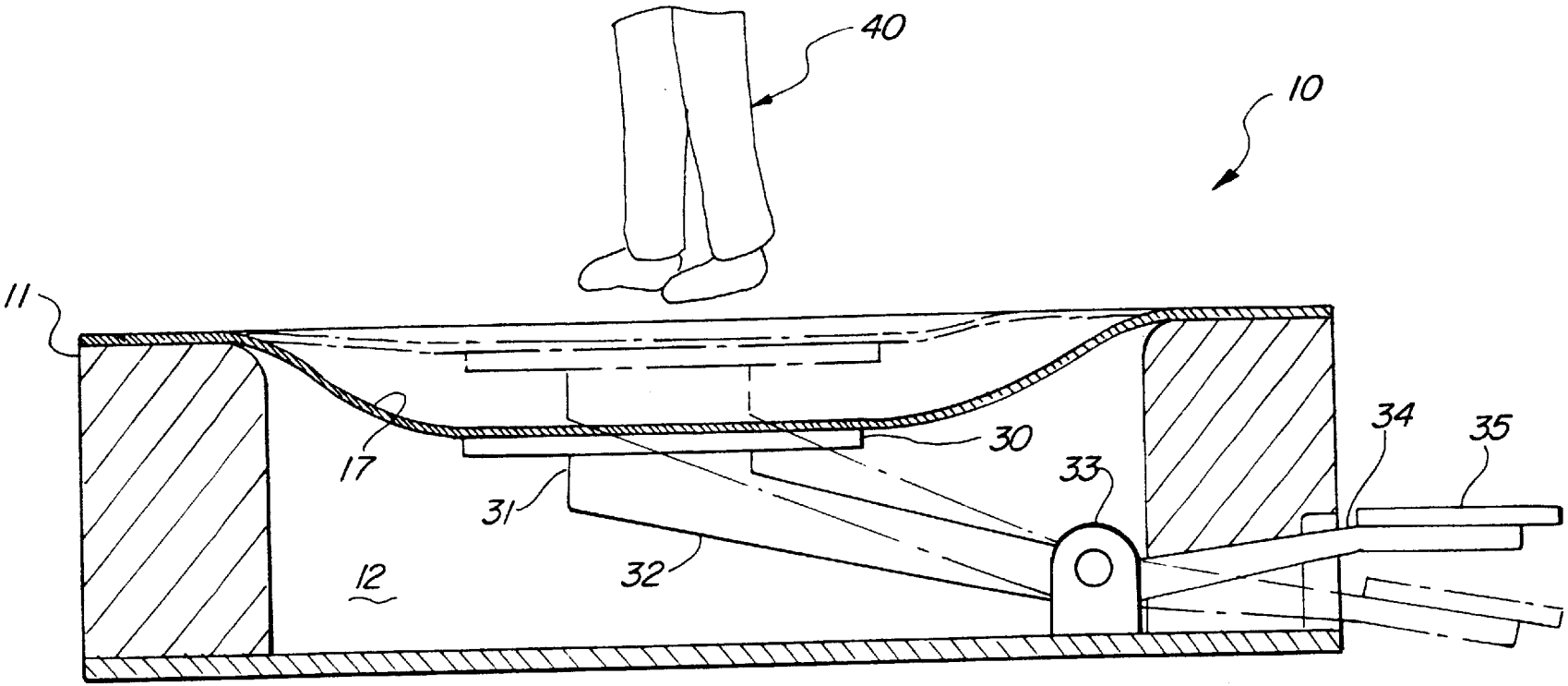
FIG. 2 sets forth a section view of the present invention toy doll bed having jumping doll.

FIG. 2 sets forth a section view of the present invention toy doll bed having a jumping doll shown partial depiction therewith. As described above, toy doll bed 10 includes a base 11 having a fabric cover 17 and forming a recess 12 therein. Within recess 12, a platform 30 is positioned beneath the portion of fabric cover 17 which overlies recess 12. Platform 30 is supported by a post 31 which, in turn, is supported by an arm 32. An arm 34 is joined to arm 32 at a pivot 33. Arm 34 extends outwardly from base 11 and supports a pad 35. A doll 40 is movable above recess 12 and is acted upon in the manner described above by the movement of platform 30 and its own weight together with the elastic force of elastic bands 42 and 43 (seen in FIG. 1).

In the solid line depiction shown in FIG. 2, platform 30 is lowered due to the greater length of arm 32 relative to arm 34 and the placement of pivot 33. Also shown in FIG. 2 in dashed phantom line depiction, is the raised position of platform 30 produced as the user depresses pad 35 in the above described manner to exert upward force against doll 40.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy doll bed comprising:

a base having an upper surface and a recess;

a fabric layer loosely spanning said recess;

a platform and a pivot arm supporting said platform within said recess beneath said fabric layer;

a depressible pad and arm coupled to said pivot arm;

a pivot pivotally supporting said arm and said pivot arm;

a doll; and means for resiliently supporting said doll upon said fabric and said platform.

* * * * *